US005894929A

United States Patent [19]

Kai et al.

[11] Patent Number: 5,894,929

[45] Date of Patent: Apr. 20, 1999

[54] VACUUM PACKAGING BAG AND VACUUM PACKAGING METHOD

[75] Inventors: Hisao Kai, Chiba-ken; Kazumi Umezawa, Kanagawa-ken, both of Japan

[73] Assignee: Yugenkaisha Kusaka Raremetal Kenkyusho, Tokyo, Japan

[21] Appl. No.: 08/880,243

[22] Filed: Jun. 23, 1997

[51] Int. Cl.[6] ..... B65D 81/20; B65D 33/01

[52] U.S. Cl. ..... 206/524.8; 383/100; 476/113; 476/118

[58] Field of Search ..... 206/484, 524.8; 383/100, 103; 426/107, 113, 118, 395

[56] References Cited

U.S. PATENT DOCUMENTS

| | | | |
|---|---|---|---|
| 2,595,708 | 5/1952 | Salfisberg | 383/100 X |
| 2,807,550 | 9/1957 | Zarotschenzeff et al. | 426/113 |
| 2,870,954 | 1/1959 | Kulesza | 426/118 |
| 3,008,837 | 11/1961 | Kaplan | 426/113 X |
| 3,637,132 | 1/1972 | Gray | 383/100 |
| 3,937,396 | 2/1976 | Schneider | 426/113 X |
| 4,834,554 | 5/1989 | Stetler, Jr. et al. . | |
| 4,890,744 | 1/1990 | Lane, Jr. et al. | 206/484 X |

FOREIGN PATENT DOCUMENTS

| | | | |
|---|---|---|---|
| 0537109 | 4/1993 | European Pat. Off. . | |
| 0683105 | 11/1995 | European Pat. Off. . | |
| 405278751 | 10/1993 | Japan | 383/100 |
| 7-242212 | 9/1995 | Japan . | |
| 08244796 | 9/1996 | Japan . | |
| 8-244796 | 9/1996 | Japan . | |
| 08253268 | 10/1996 | Japan . | |
| 8-253268 | 10/1996 | Japan . | |
| WO90/05545 | 5/1990 | WIPO . | |

*Primary Examiner*—Bryon P. Gehman
*Attorney, Agent, or Firm*—Jordan and Hamburg

[57] ABSTRACT

Disclosed is a sterilizing and vacuum packaging bag having at least one non-fused degassing portion, wherein an insufficiently fused area is present inside the degassing portion. The insufficiently fused area is lower in fusion strength than the vertical fused areas and a bag mouth fused area, and is fused so as to be separable by an increase in inner pressure. Further disclosed is a vacuum packaging method comprising using this sterilizing and vacuum packaging bag, including putting contents into the bag through an open end thereof, fusing the open end more firmly than the insufficiently fused area, performing microwave heating, separating films fused together at the insufficiently fused area at a stage that the surface temperature of the contents is also sufficiently elevated, and completely fusing the degassing portion after termination of microwave heating. As a result, in the vacuum packaging technique utilizing microwave heating, the surface temperature of the contents can be prevented from being lowered to obtain a good sterilized state. Further, even when the contents contain fluid water, leakage of water can be prevented during vacuum packaging.

5 Claims, 5 Drawing Sheets

VACUUM PACKAGING BAG AND VACUUM PACKAGING METHOD

FIELD OF THE INVENTION

The present invention relates to a vacuum packaging bag for hygienically packaging food such as meat, vegetables, fruit and seaweeds, medical implements such as injectors, or sanitary items made of fiber such as nonwoven fabric and gauze, in the presence of water, and a vacuum packaging method using the same.

BACKGROUND OF THE INVENTION

Previously, vacuum packaging bags have been proposed in each of which one end is opened and the other end has at least one strip-like bag mouth fused area provided with a non-fused degassing portion(s). When one bag mouth fused area is formed, a sufficient blank area is provided outside the bag mouth fused area. When two or more bag mouth fused areas are formed, they are arranged in such a manner that the degassing portions of the adjacent areas are not in contact with each other.

Contents such as food are put into the bag through the open end, followed by sealing of the open end by means of fusion or clipping. Then, the contents are heated from the inside thereof by microwave heating to complete heat sterilization of the contents for a short period of time. Thus, the contents can be sterilized and vacuum packaged without heat deterioration. Water vapor generated by the microwave heating is evacuated from the bag through the degassing portion(s) formed in the bag mouth fused area(s) and a duct(s) formed between the two or more bag mouth fused areas. The water vapor in the bag and the duct(s) condenses simultaneously with completion of the microwave heating to adhere films forming the duct(s) to each other, thereby closing the duct(s) to prevent air containing various germs from flowing back into the bag. That is, sterilization and vacuum packaging can be easily performed by use of the microwave heating.

According to the above-mentioned method, however, the contents are put into the bag turned upside down. Accordingly, when the contents contain fluid water as in the case of cooked food, it becomes clear that the fluid water enters the duct(s) or leaks to the outside through the open degassing portion(s), resulting in incomplete vacuum packaging.

When the microwave heating is conducted while generating water vapor, the contents are heated from the inside thereof. It has been discovered that the surface of the contents is only heated to about 96° C. to about 97° C. due to vaporization latent heat, although the inside thereof is heated to 104° C. to about 105° C., because the water vapor is generated from only the surface thereof at this time.

When sterilization packaging by the foregoing microwave heating method is attempted, it has been discovered that surfaces of articles to be sterilized are in fact insufficiently sterilized.

SUMMARY OF THE INVENTION

The present invention relates to an improvement of a sterilizing and vacuum packaging method by microwave eating which can sufficiently sterilize even the surface of contents, and can sterilize and vacuum package the contents even though it contains much fluid water.

According to the present invention, there is provided a sterilizing and vacuum packaging bag one end of which is opened and the other end of which has at least one strip-like bag mouth fused area provided with at least one non-fused degassing portion, wherein an insufficiently fused area is formed inside said degassing portion, said insufficiently fused area being lower in fusion strength than vertical fused areas and the strip-like bag mouth fused area, and being weakly fused so as to be separable by an increase in inner pressure. Further, the present invention provides a vacuum packaging method using this sterilizing and vacuum packaging bag comprising putting contents into the bag through the open end thereof, fusing said open end more firmly than the insufficiently fused area, performing microwave heating, separating films fused together at the insufficiently fused area at a stage that the surface temperature of the contents is also sufficiently elevated, and completely fusing the degassing portion after termination of microwave heating.

That is, the use of the conventional vacuum packaging bags has raised the problem that when the contents are put into the bags turned upside down, water leaks to the outside through the open degassing portions. However, this problem has been solved by providing the insufficiently fused area.

The insufficiently fused area is formed inside the degassing portion, so that it can prevent water from leaking through the degassing portion.

The microwave heating is performed with the open end of the bag directed upward. When the inner pressure is elevated by the microwave heating, the films fused together at the insufficiently fused area are separated by the inner pressure because of low adhesion strength thereof, resulting in release of water vapor through the degassing portion and a duct formed between at least two strip-like bag mouth fused areas.

Further, the inside of the vacuum packaging bag is sealed by the presence of the insufficiently fused area until the inner pressure reaches a pressure by which the films fused together at the insufficiently fused area are separated. As a result, evaporation of water vapor from the surface of the contents is inhibited to prevent the temperature of the surface from being lowered, which makes it possible to obtain a higher sterilization condition.

When the inner pressure reaches a definite value, the films fused together at the insufficiently fused area are separated all at once with an explosion "pop" to initiate release of water vapor.

DETAILED DESCRIPTION OF THE INVENTION

It is preferred that the contents used in the present invention contain some water. The present invention is based on the assumption that the contents are heated by microwave heating. Accordingly, the water of the contents is heated from the inside thereof to elevate the temperature of the whole contents for a short period of time, which causes very little quality deterioration of the contents due to heating, differing from external heating.

The present invention can be applied to general food as such. However, food for eating raw is unsuitable because it is heated. Food largely composed of water, such as soup, is unfavorably liable to overflow from a degassing portion when boiled. However, the application of the present invention to such food becomes possible by widening the degassing portion and providing a sufficient blank area.

Also when the contents contain no water at all like surgical knives or injectors, supply of a small amount of water permits the use of the present invention. For sanitary items such as nonwoven fabric and gauze, the effect of the present invention can also be achieved by supplying water.

The germ-free condition can be maintained after packaging by adding a small amount of a disinfectant solution such as diluted sodium hypochlorite or hydrogen peroxide to germs which form spores resistant to heat sterilization. Further, in the case of this invention, heating is conducted in the partially opened state, different from the conventional retort system. The present invention therefore has the advantage that the disinfectant which has performed the sterilization function under heating is discharged outside together with water vapor generated during heating and does not remain in the packaging bag.

There is no particular limitation on the plastic bags used in the present invention. Examples thereof include the four-side seal type, the three-side seal type having a fused area at a center portion or an edge portion, the two-side seal type using a tubular film as it is, the gusset fold type and the stand pack type. Although the bag may be formed of a monolayer film, it is preferably formed of a multilayer film with an inner heat-fusible layer. Materials for the bags are required to be ones into which air does not penetrate even when they are stored for a long period of time, and which do not deteriorate or deform under steam of 100° C. In particular, a bag made at a laminated film of polyvinylidene chloride resin layers is preferred, because of its high air shutoff properties and transparency.

Figure 1:
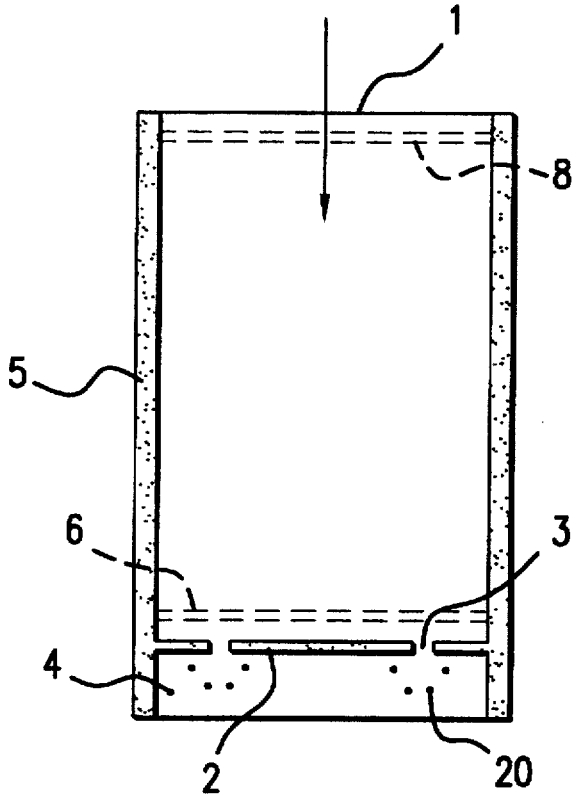
FIG. 1 is a front view showing one embodiment of a vacuum packaging bag of the present invention turned upside down.

The vacuum packaging bag is opened at the bottom thereof to form an open bottom end 1. As shown in FIG. 1, the bag is turned upside down, and the contents are put into the bag through the open bottom end 1. A strip-like bag mouth fused area 2 is formed at the side opposite to the open bottom end 1. The term "strip-like" is intended to define an area having a width necessary for preventing the fused area from being separated by an increase in the inner pressure of the bag. The strip-like bag mouth fused area 2 is firmly fused, but has at least one partially non-fused portion, which is a degassing portion 3. The degassing portion 3 is not so long as a duct, and is formed only by partial non-fusion. The degassing portion 3 may have an opening enough to release a large amount of water vapor generated by microwave heating.

One or more degassing portions 3 may be formed per one bag mouth fused area 2. In some cases, the bag mouth fused area 2 may be intermittently fused to form a number of degassing portions 3. The degassing portion 3 may be formed at a center portion or edge portions.

In FIG. 1, a non-fused blank area 4 is provided outside the bag mouth fused area 2, and fused spots 20 are disposed so as to cover the degassing portion 3. The vertical length of the blank area 4 is 2 cm or more, preferably 3 cm or more, and more preferably 5 cm or more. The blank area 4 having a vertical length of 2 cm or more is closed immediately after termination of the microwave heating, even when the bag is provided with one bag mouth fused area 2, to prevent not only air, but also various germs from entering the bag. The blank area 4 is made in short tubular form by fusing both sides to form vertical fused areas 5.

Further, the fused spots 20 disposed in the blank area 4 do not inhibit release of water vapor during the microwave heating, and allow the films in the blank area 4 to adhere immediately after termination of the microwave heating.

The synergistic effect of the blank area 4 and the fused spots 20 can surely prevent various germs from entering the bag after termination of the microwave heating, even when the bag is provided with one bag mouth fused area 2.

In the present invention, an insufficiently fused area 6 is formed inside the bag mouth fused area 2. The insufficiently fused area 6 should be hermetically fused without a non-fused portion. The insufficiently fused area 6 is required to be substantially completely fused, but to be low in fusion strength so as to be easily separable by an increase in inner pressure when the contents in the sealed bag is heated by the microwave heating. That is, the fusion should not be so strong that a film, a material for the bag, is broken by an increase in inner pressure. The insufficient fusion strength is measured in accordance with JIS Z 1707, and is 0.7 to 3.0 kg/15 mm in width, preferably 0.9 to 2.4 kg/15 mm in width, and more preferably 1.0 to 1.8 kg/15 mm in width.

When the bag mouth fused area 2 or a fused bottom area 8 is formed, a sealer using a heat bar or the like or an impulse sealer is employed. A contact surface of a heating instrument with the film is covered with a releasing material such as Teflon so that the film does not adhere to the heating instrument.

For formation of the insufficiently fused area, a special sealer may be used. However, releasing tapes such as Teflon tapes can be further adhered in layers to only the insufficiently fused area so as to give an appropriate thickness to adjust the heating temperature, thereby forming the bag mouth fused area and the insufficiently fused area at the same time.

The insufficiently fused area may be formed by any other methods as long as the above-mentioned conditions are satisfied.

The vacuum packaging bag of the present invention is not limited to one shown in FIG. 1. Any vacuum packaging bags may be used, and as long as they have the insufficiently fused areas 6 most inside and bottoms of the bags can be surely sealed after charging of the contents.

For example, as shown in FIG. 3(*a*), a vacuum packaging bag can also be used which has two bag mouth fused areas 2 arranged in parallel with and adjacent to each other, a duct 7 being formed therebetween keeping a spacing through which water vapor generated inside the bag can be released, each of said bag mouth fused areas 2 having one degassing portion 3 at each different end thereof. In this case, a blank area has a vertical length of about 5 mm, and does not have the effect of the blank area 4 in FIG. 1.

Referring to FIG. 3(*b*), one of two bag mouth fused areas 2 arranged in parallel with and adjacent to each other has two degassing portions 3 at both ends thereof. When two or more bag mouth fused areas 2 are provided, the degassing portions 3 of the bag mouth fused areas 2 adjacent to each other are preferably disposed apart from each other. A duct 7 is formed between two bag mouth fused areas 2 adjacent to each other by disposing the degassing portions 3 apart from each other, and water vapor and air are forced to pass through the duct 7, which exerts no adverse effect on exhaust in heating and prevents various germs from entering the bag on termination of the heating.

FIG. 3(*c*) shows a bag having three bag mouth fused areas 2. The bag mouth fused area located most inside has a plurality of degassing portions 3, and all the degassing portions 3 are sealed by insufficiently fused areas 6. Accordingly, a bag mouth of the vacuum packaging bag shown in FIG. 3(*c*) is completely sealed. The inner pressure is increased by the microwave heating, and vaporization latent heat is not taken from the surface of the contents before separation of the insufficiently fused areas 6, resulting in a sufficient increase in surface temperature. After separation of the insufficiently fused areas 6, water vapor is released through the degassing portions 3 and a duct 7, so that there is no danger of an abnormal increase in inner pressure.

In FIG. 3(*d*), a degassing portion 3 of a bag mouth fused area 2 located inside is provided with an insufficiently fused area 6. The reference numeral 19 designates a supplementary fused area for preventing liquid leakage during the microwave heating.

All the embodiments shown in FIG. 3 each have two or more bag mouth fused areas, and the degassing portions 3 of the bag mouth fused areas adjacent to each other are disposed apart from each other.

Figure 2:
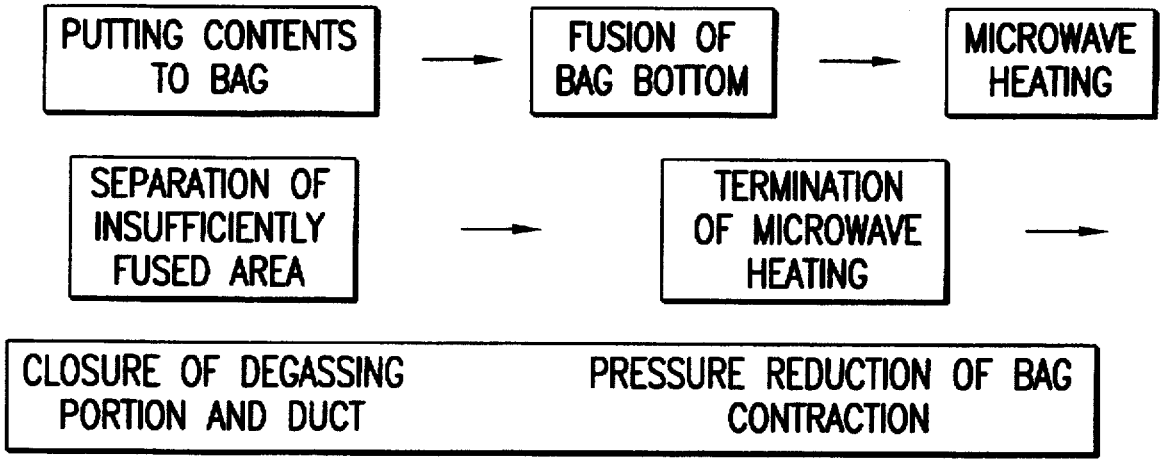
FIG. 2 is a flow sheet illustrating a vacuum packaging method of the present invention.
Figure 3A:
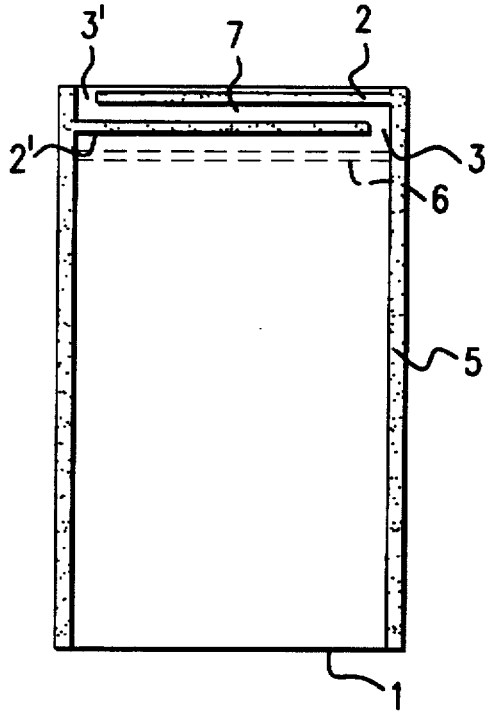
FIGS. 3(*a*), 3(*b*), 3(*c*) and 3(*d*) are front views showing other embodiments of vacuum packaging bags of the present invention.
Figure 3B:
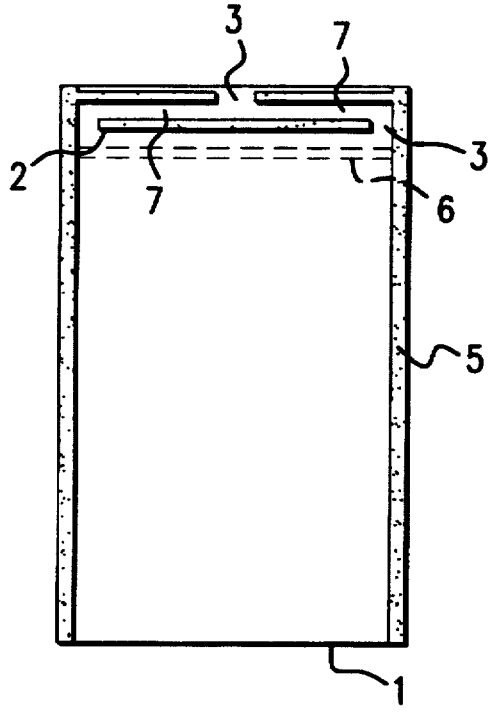
Figure 3C:
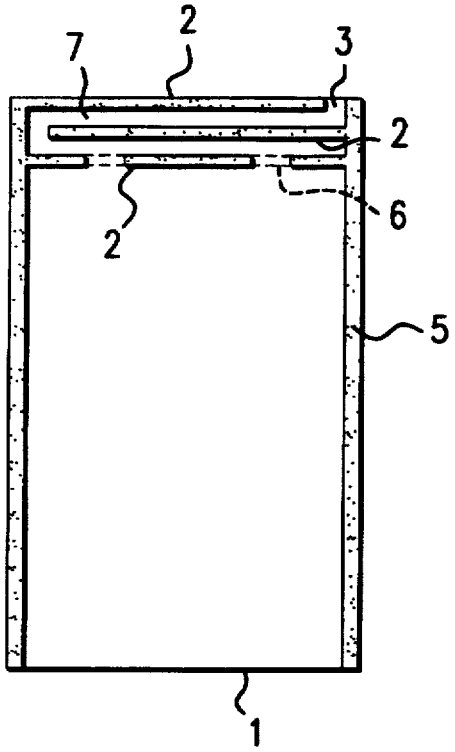
Figure 3D:
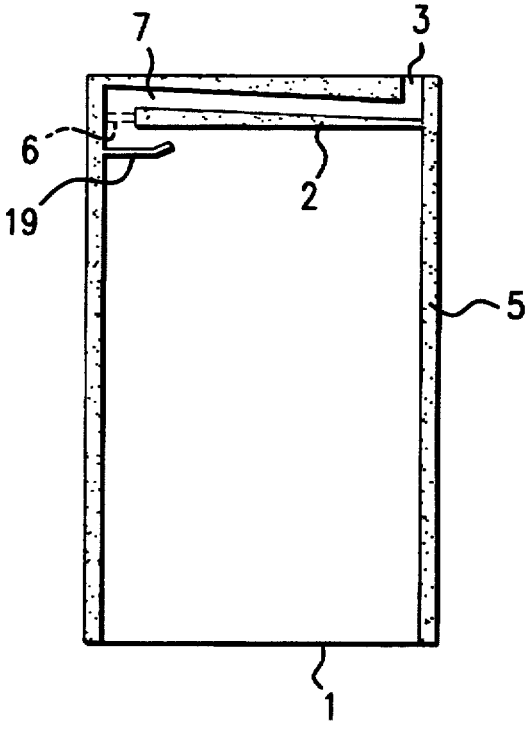

FIG. 2 is a flow sheet illustrating a vacuum packaging method of the present invention. As shown in FIG. 1, the vacuum packaging bag is turned upside down, and the contents are put into the bag through the open bottom end 1 directed upward. Even when the contents contain fluid water like cooked food, there is no fear of liquid leakage because the insufficiently fused area 6 exists most inside.

Then, the bottom end of the bag is sealed. As sealing means, the complete fusion is preferred. In some cases, the bottom end may be fastened with a sealable heat-resistant clip. In this state, the contents exist in the completely sealed bag.

Thereafter, the microwave heating is performed. As a microwave heating apparatus, either a commercially available electronic oven or a large-sized efficient microwave heating apparatus manufactured for industrial use may be used. In this case, it is preferred to conduct treatment with the bag mouth directed upward. The contents are heated from the inside thereof. However, water vapor can not be sufficiently evaporated because the bag is sealed. Accordingly, vaporization latent heat is not taken from the surface of the contents, and the surface temperature is also elevated to about 100° C. When the heating proceeds and the inner pressure reaches a definite value, the films fused together at the insufficiently fused area 6 more weakly than the other fused areas are separated with an explosion "pop" to release water vapor from the bag through the degassing portions 3 formed in the bag mouth fused area 2.

Termination of the microwave heating results in condensation of water vapor to reduce the inner pressure of the vacuum packaging bag, which causes contraction of the inside of the bag, the blank area 4 shown in FIG. 1, and a duct 7 formed between the two bag mouth fused areas 2 in FIG. 3, whereby the front and back films forming the bag adhere to each other in the presence of water to keep the packaging bag in the vacuum state. Then, the degassing portions are completely fused, and the vacuum packaging bag is cooled. Thus, a vacuum packaged product in which the contents are sterilized can be obtained.

Further, when the contents is put into an ordinary bag having a bottom and then a bag mouth thereof is fused, two or more strip-like fused areas may be provided, and the strip-like fused area disposed most inside may be partially or wholly used as an insufficiently fused area, thereby obtaining the effect of the present invention. In this case, the other strip-like fused areas having no insufficiently fused areas require formation of degassing portions.

EXAMPLE 1

A vacuum packaging bag having the shape shown in FIG. 3(*a*) was used in which a nylon base film coated with polyvinylidene chloride layers is laminated with a linear low density polyethylene layer as a heat-fusible layer on one side thereof. The insufficiently fused area 6 was formed by use of a Shop Sealer Type FS315 fusing device (manufactured by Fuji Impulse Co.) equipped with dials 1 to 7 as a timer for setting the energizing time to effect fusion at varying fusion strengths per unit area. At dial 4 in this timer, the front and back films were fused together to such a degree that the films were separated when pulled with somewhat strong force by hand.

When the dial was set to 4.5, 5 and 6, the front and back films were completely fused together. Even when pulled, the films were not separated at the fused area, and were not broken. On the other hand, when the dial is set to 3.5, the front and back films were not substantially fused, and were separated with weak force with no substantial resistance.

In this embodiment, it became clear that the preferred insufficient fusion strength was obtained at a dial scale ranging from 3.7 to 4.3.

A cylindrical material for a four-side seal type bag having a length of 25 cm, a width of 15 cm and 7-mm wide vertical fused areas at both sides was prepared. The vertical fused areas 5 and a bag mouth fused area 2 were formed by fusing front and back films by setting the dial scale of the above-mentioned fusing device to 6. An insufficiently fused area 6 was formed by fusing the films at a dial scale of 4.0.

Peeled potatoes were put into the resulting vacuum packaging bag, with a bottom end of the bag directed upward, and then, the films were fused together at the open bottom end 1 by setting the dial scale of the fusing device to 6, as shown in FIG. 1. The reference numeral 8 designates a bottom fused area obtained by fusing the films after charging of the potatoes.

After fusion of the bottom end of the bag, microwave heating was conducted, directing the bag mouth upward again. The potatoes were heated, and starch was converted to the α-form. The films fused together at the insufficiently fused area 6 were separated all at once with an explosion, 17 seconds after filling of water vapor in the vacuum packaging bag. After separation, the water vapor was released through the degassing portions 3 and the duct 7. When the microwave heating was terminated, the pressure in the bag and the duct was reduced to adhere the films to each other in the presence of water in the duct, thereby keeping the inside of the bag hermetic. After cooling, the films were fused together at the degassing portions and the duct to completely seal the whole bag.

In this embodiment, it only took 15 to 20 seconds after the filling of water vapor in the bag until the separation of the insufficiently fused area. Water vaporization latent heat was therefore not taken from the surface of the contents, and the surface temperature reached 99° C. Accordingly, vacuum packaged potatoes sterilized and cooked to an almost satisfactory degree could be obtained. The vacuum packaged potatoes were allowed to stand at room temperature for 3 months, and then opened. The potatoes were maintained fresh, and were not soggy and tasted very good to the cores thereof.

EXAMPLE 2

Cooked pork was put into the vacuum packaging bag used in Example 1, and treated in the same manner as with Example 1. Although the cooked pork contained some stock, no stock exuded through the degassing portions 3 because of formation of the insufficiently fused area 6. The films fused together at the insufficiently fused area 6 were separated, 16 seconds after filling of water vapor in the bag, to initiate release of water vapor through the degassing portions 3. No leakage of the stock was observed.

For the resulting sterilized vacuum packaging bag, the degassing portions were completely fused afterward collectively. The bag was opened after standing at room temperature for 1 month. The contents had a taste not different from that just after cooking.

COMPARATIVE EXAMPLE 1

The microwave heating was conducted in the same manner as with Example 1 with the exception that a vacuum packaging bag shown in FIG. 3(*a*) was used in which of the bag mouth fused areas 2 and 2', the bag mouth fused area 2' near to the insufficiently fused area 6 was formed by incomplete fusion by setting the dial of the above-mentioned fusing device to 4.

When the films were separated at the insufficiently fused area 6, they were also separated at the bag mouth fused area 2' at the same time. When the bag was contracted after termination of the microwave heating, air flowed backward from the degassing portion 3' formed at the outer bag mouth fused area 2, resulting in insufficient sterilization.

EXAMPLE 3

Figure 4:
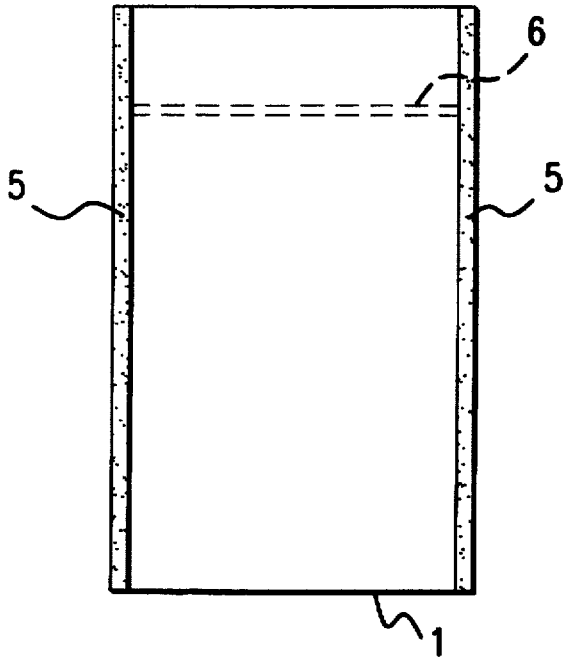
FIG. 4 is a front view showing a material for a further embodiment of a vacuum packaging bag of the present invention.
Figure 5:
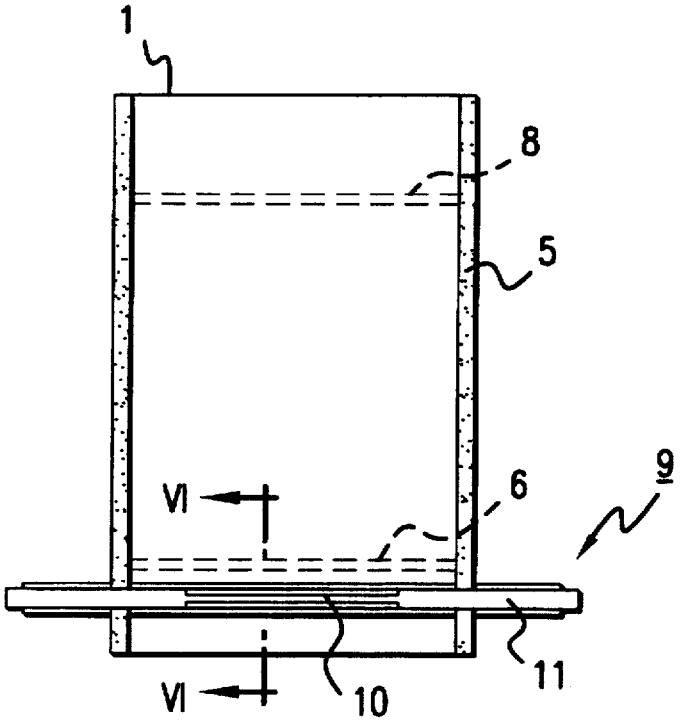
FIG. 5 is a front view showing the material for the vacuum packaging bag of FIG. 4 with a clip attached.

A cylindrical material for a vacuum packaging bag was used in which two vertical fused areas 5 completely fused were formed at both sides and an insufficiently fused area 6 was formed somewhat inside at an open end, as shown in FIG. 4. A portion outside the insufficiently fused area 6 was fastened by use of a clip 9. As shown in FIG. 5, the contents were put into the bag, with an open bag mouth end 1 directed downward, and the open bag mouth end 1 was closed by fusion.

Aside from this, the open bag mouth end 1 was closed by use of another clip in which a male member was hermetically received in a female member.

In this embodiment, the clip 9 used at the portion outside the insufficiently fused area 6 had completely adhered portions 11 and a small-diameter portion 10 having air permeability. In the small-diameter portion 10, a clearance was formed between the female member 12 and the male member 13. In this clearance 14, a passageway was formed between front and back films 15 and 16 forming the vacuum packaging bag.

Figure 6:
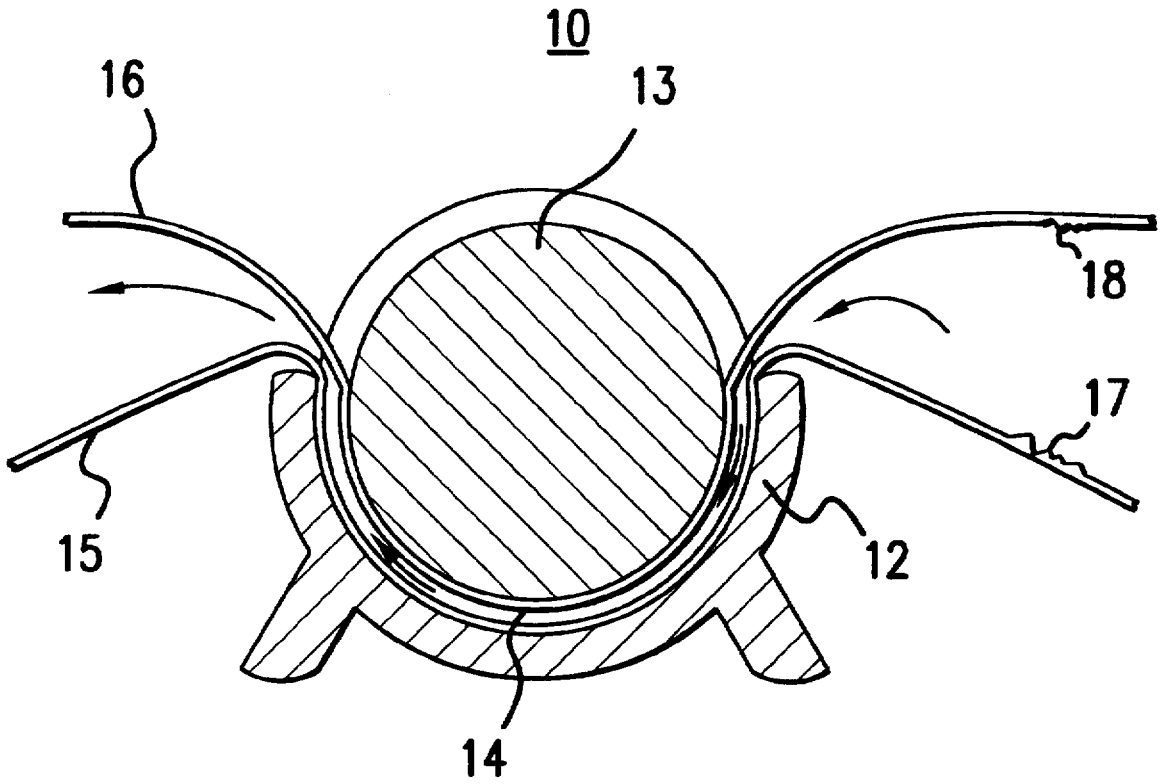
FIG. 6 is a cross sectional view taken in the direction of the arrows along line VI—VI of FIG. 5.

When the microwave heating was initiated, the contents in the bag sealed by the vertical fused areas 5, the insufficiently fused area 6 and the open bag mouth end 1 fused or closed by clipping were uniformly heated throughout to elevate the inner pressure. When the inner pressure reached a definite value, the films fused together at the insufficiently fused area 6 were separated. After separation, water vapor was discharged outside through the clearance 14 as indicated by the arrow in FIG. 6. After termination of the microwave heating, the front and back films 15 and 16 in the clearance 14 adhered to each other by wetting of the inner surface thereof, so that contamination with various germs could be prevented. The reference numerals 17 and 18 designate separated sites of the films, respectively.

Then, the films were completely fused together at the outside or the inside of the clip 9, or a sealing type clip having no small-diameter portion 10 was attached thereat, thereby maintaining the contents in the sterilized vacuum-packaged state. Cooling may be carried out before, after or during complete sealing by fusion or clipping.

In this embodiment, the male member of the clip 9 was partially decreased in diameter to form the clearance 14. However, it is also possible to form the clearance 14 by increasing the inner diameter of the female member or using both in combination.

According to this embodiment, when the films were fused together at the outside or the inside of the clip 9, and when the sealing type clip having no small-diameter portion 10 was attached thereat, the contents could be maintained in the highly sterilized vacuum-packaged state, similarly to Examples 1 and 2.

What is claimed is:

1. A vacuum packaging bag for packaging a product, comprising:

a bag body formed of a plastic film material which has first and second film sides with first and second opposing side edges thereof connected respectively together to form a structure which is tubular in form when said first and second film sides are displaced from one another to define a container volume therebetween for holding the product;

said bag body having a first end whereat said first and second sides are not sealed together across a width of the bag body so as to permit said first end to be opened for introduction of the product into said container volume;

said bag body having a second end with a first fused area whereat said first and second film sides are fused together at a first fusion strength per unit of area across the width of the bag body except at at least one degassing portion, whereat the first and second film sides are not fused together, for permitting escape of gas from said container volume when a gas pressure inside said container volume is increased due to heating product contained therein, said first fusion strength per unit area being sufficient to prevent separation of said first and second film sides by the gas pressure the heating resulting from, and a second fused area, interior of said first fused area with respect to said container volume, whereat said first and second film sides are fused together at a second fusion strength per unit area across an entirely of the width of the bag body to form a seal across said bag body, the second fusion strength per unit area being less than said first fusion strength per unit area such that said second fused area is insufficiently fused to prevent separation of said first and second film sides due to the gas pressure the heating resulting from so that said first and second film sides separate from each other at said second fused area to permit gas to pass through said at least one degassing portion.

2. The vacuum packaging bag as claimed in claim 1, wherein the fusion strength of the second fused areas, measured in accordance with JIS Z 1707, is 0.7 to 3.0 kg/15 mm.

3. The vacuum packaging bag as claimed in claim 1, wherein said first and second film sides extend adjacent one another and exterior to said at least one degrassing portion a length of at least 2 cm.

4. The vacuum packaging bag as claimed in claim 1, further comprising:

said bag body having a third fused area whereat said first and second film sides are fused together at at least said first fusion strength per unit of area across the width of the bag body with the exception of at least one degassing portion, whereat the first and second film sides are not fused together, for permitting escape of the gas from said container volume; and said third fused area being disposed adjacent said first fused area to define a duct therebetween through which water vapor generated inside said container volume is released along with said gas.

5. A vacuum packaging bag for packaging a product, comprising:

a bag body formed of a plastic film material which has first and second film sides with first and second opposing side edges thereof connected respectively together to form a structure which is tubular in form when said first and second film sides are displaced from one another to define a container volume therebetween for holding the product;

said bag body having a first end whereat said first and second sides are not sealed together across a width of the bag body so as to permit said first end to be opened for introduction of the product into said container volume;

said bag body having a second end with a first fused area whereat said first and second film sides are fused together at a first fusion strength per unit of area across the width of the bag body except at at least one degrassing portion for permitting escape of gas from said container volume when a gas pressure inside said container volume is increased due to heating the product contained therein, said first fusion strength per unit area being sufficient to prevent separation of said first and second film sides by the gas pressure resulting from the heating;

said bag body having a second fused area whereat said first and second film sides are fused together at at least said first fusion strength per unit of area across the width of the bag body with the exception of at least one degassing portion for permitting escape of the gas from said container volume;

said second fused area being disposed interior of and adjacent said first fused area to define a duct therebetween through which water vapor generated inside the bag can be released along with the gas; and said first and second film sides at said at least one degassing portion of said second fused area being fused together to form a seal across said bag body in conjunction with said second fused area and being fused at a second fusion strength per unit area lower than said first fusion strength per unit area of said first and second fused areas so said first and second film sides are separable by the gas pressure resulting from the heating to permit the gas and water vapor to pass through said at least one degrassing portion.

* * * * *